United States Patent [19]

Wenig

[11] Patent Number: 4,458,726

[45] Date of Patent: Jul. 10, 1984

[54] APPARATUS FOR CONTROLLING WEFT PICKING

[75] Inventor: Ernst Wenig, Oehningen, Fed. Rep. of Germany

[73] Assignee: Sulzer Brothers, Ltd., Winterthur, Switzerland

[21] Appl. No.: 226,542

[22] Filed: Jan. 21, 1981

[30] Foreign Application Priority Data

Jan. 23, 1980 [CH] Switzerland ..... 525/80

[51] Int. Cl.[3] ..... D03D 41/00

[52] U.S. Cl. ..... 139/11; 139/116; 139/435; 139/439; 139/450

[58] Field of Search ..... 139/341, 435, 439, 452, 139/450, 370.2, 11, 116

[56] References Cited

U.S. PATENT DOCUMENTS 3,757,831 9/1973 Loepfe et al. ..... 139/341
4,020,877 5/1977 Spisiak et al. ..... 139/435
4,298,172 11/1981 Hellstrom ..... 139/452

FOREIGN PATENT DOCUMENTS 533686 11/1976 U.S.S.R. ..... 139/435
632773 11/1978 U.S.S.R. ..... 139/435
735683 5/1980 U.S.S.R. ..... 139/435

*Primary Examiner*—Henry Jaudon

[57] ABSTRACT

The weaving machine has a weft picking mechanism which is controlled so as to adjust the picking speed of the weft yarn relative to the operating speed of the weaving machine. The means for controlling the picking mechanism receives an error signal from a comparator connected on the input side to a pick-off for detecting the arrival of a weft yarn at the weft catching station and a second pick-off for detecting the operating speed of the machine. The error signal may also be used to control a fluid type of weaving machine or may be used to control the drive of the weaving machine relative to the picking mechanism.

8 Claims, 2 Drawing Figures

APPARATUS FOR CONTROLLING WEFT PICKING

Figure 1:
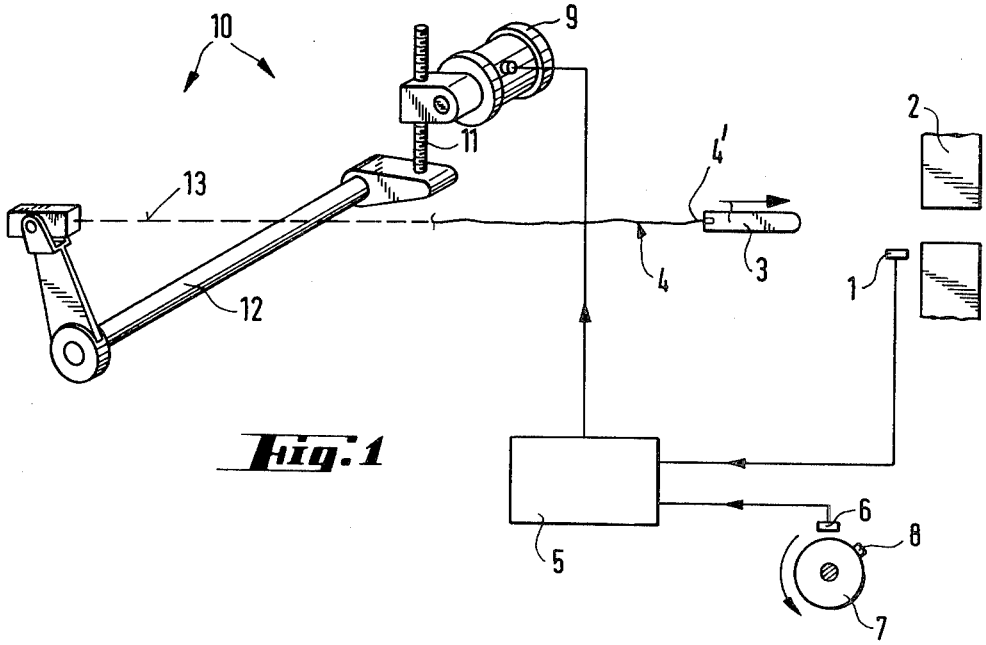

This invention relates to an apparatus for controlling weft picking. More particularly, this invention relates to an apparatus for controlling the picking operation of a weaving machine.

As is known, weaving machines such as gripper projectile weaving machines have been known to employ a weft-picking mechanism for picking a weft yarn through a shed to a weft catching station. It has also been known to use a pick-off arrangement in order to determine whether the instant of time at which the gripper projectile enters the catching area of the weaving machine coincides with the operating speed of the weaving machine. For example, the pick-off arrangement may use one pick-off to detect and signal the arrival of the weft yarn in the catching area and a second pick-off to detect and signal a set-value angular position of the main shaft of the machine and, thus, the machine speed. In the absence of coincidence of the signals obtained by the two pick-offs, the drive control system of the machine stops the machine. The picking mechanism can then be adjusted manually in order to restore coincidence. However, this is a disadvantage since a manual adjustment takes considerable time.

Further, it has been known that discrepencies frequently occur in the operation of a weaving machine and/or picking mechanism due to operational variations, for instance, due to the warming up of the machine, altered friction due to different lubrication, variations in drive speed and yarn texture. Thus, these operational variations may require frequent adjustment of the machine and, thus, additional down-time.

Similar considerations also apply to weaving machines which employ fluid picking mechanisms, such as air jet weaving machines and water jet weaving machines.

Accordingly, it is an object of the invention to provide a weaving machine wherein picking can be continuously adapted to machine speed without the need for a manual adjustment.

It is another object of the invention to adjust the picking rate of a picking mechanism relative to the operating speed of a weaving machine in a relatively simple and rapid manner.

Briefly, the invention provides a weaving machine with a picking mechanism for picking a weft yarn to a weft-catching station, a first pick-off for generating a first signal in response to the arrival of a weft yarn at the weft-catching station and a second pick-off for generating a second signal corresponding to the operating speed of a weaving machine. In addition, the invention provides a comparator which is connected to each of the pick-offs in order to receive and compare the two signals and to generate an error signal in response to the signal from the first pick-off deviating from the signal from the second pick-off. Further, a means is connected to the comparator to receive the error signal and to adjust the picking speed of the weft yarn to the speed of the weaving machine in response to the error signal.

The means which is connected to the comparator to receive the error signal may be connected to the picking mechanism or a main drive for driving the weaving machine. In one embodiment, the picking mechanism includes a torsion bar for effecting a picking of a gripper shuttle and the means for adjusting the picking speed includes an adjusting screw for determining a zero position of the torsion bar and a servo-motor for adjusting the position of the screw. In this embodiment, the servomotor is connected to the comparator to receive the error signal and to adjust the screw in response to the error signal.

In another embodiment, for example where the weaving machine is of a fluid type, the picking mechanism may include at least one nozzle for passage of a weft yarn therethrough and supply means for supplying a fluid to the nozzle to propel a weft yarn therethrough. In this case, the means for adjusting the picking speed is a control valve for controlling the propelling pressure of the fluid applied to the nozzle from the supply means.

The term "operating speed" which is determined by the drive speed of the machine, is to be understood in the present context as denoting the speed at which the other events of the machine occur. Such events may, in particular, be shedding, braking of the weft yarn or the like.

Figure 2:
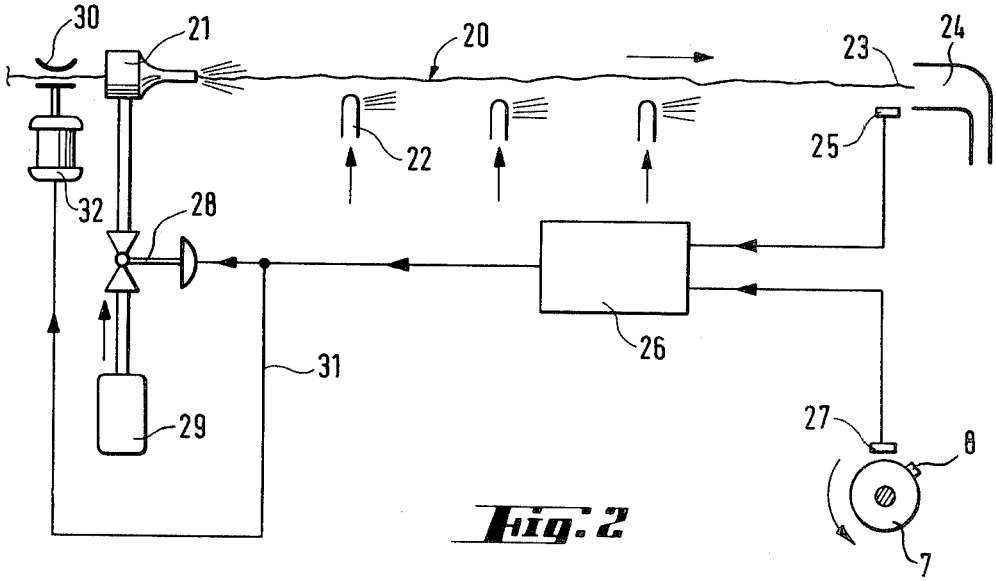

These and other objects and advantages of the invention will become more apparent from the following detailed description taken in conjunction with the accompanying drawings in which:

FIG. 1 illustrates a schematic view of a gripper projectile weaving machine employing an apparatus in accordance with the invention; and FIG. 2 illustrates a schematic view of a fluid type of weaving machine employing an apparatus in accordance with the invention.

Referring to FIG. 1, a weaving machine which is of the gripper projectile type includes a pick-off 1 which is disposed at a catching station 2 for generating a signal in response to the arrival of a gripper projectile 3 which carries the end or tip 4' of a weft yarn 4 at the weft catching station 2. The pick-off 1 is connected to a comparator 5 which has an input for receiving the signal generated by the pick-off 1.

In addition, the weaving machine has a main drive which has a main shaft 7 for driving the machine. As indicated, a second pick-off 6 is located adjacent to the main shaft 7 for generating a signal which corresponds to the operating speed of the weaving machine. This latter signal can correspond, for example, to the angular position of the main shaft 7 at the time when the gripper projectile 3 is intended to arrive at the pick-off 1. Accordingly, the main shaft 7 has a tab 8 or the like which cooperates with the pick-off 6. The pick-off 6 is also connected to an input of the comparator 5 to deliver the generated signal thereto.

The comparator 5 or comparison circuit is of known construction and receives and compares the signals from the pick-offs 1, 6 and generates an error signal of either polarity in response to the signal from the pick-off 1 deviating from the signal from the pick-off 6.

The weaving machine also has a picking mechanism for picking the weft yarn 4 to the weft-catching station 2. This picking mechanism is of generally conventional construction and, for example, includes a torsion bar 12 for picking the gripper projectile 3 through a picking path 13 for passage through a shed (not shown). The torsion bar 12 is operated in known manner by suitable means (not shown) to accelerate a gripper projectile 3 from a picking station to the catching station with the amount of acceleration being controlled by the amount of twist in the torsion bar 12. For this purpose, the torsion bar has a zero position from which the twist can be imparted for a picking operation.

A means is connected to the comparator 5 to receive the error signal and to adjust the picking speed of the weft yarn 4 to the speed of the weaving machine in response to the error signal. As indicated, this means includes an adjusting screw 11 for determining the zero position for the torsion bar 12 and a servo-motor 9 for adjusting the position of the screw. The servo-motor 9 is connected to the comparator 5 to receive the error signal and to adjust the screw 11 in response to the error signal. The motor 9 is of known construction and is connected to the screw 11 via a suitable transmission so that when the motor rotates in one direction, the screw 11 rotates and moves downward within a fixed bracket 14. Should the motor 9 rotate in the opposite direction, the screw 11 rotates and moves upward within the bracket 14. In either case, the torsion bar 12 remains in abutment with the screw 11 so that the zero position of the torsion bar 12 can be changed. In this respect, it is noted that the servo-motor 9 and adjusting screw 11 can form a part of the picking mechanism for controlling the acceleration of the picking of a weft yarn 4.

In operation, should the projectile 3, i.e. the weft yarn 4, reach the pick-off 1 too soon in relation to the operating speed of the machine, the comparator 5 generates an error signal which acts on the servo-motor 9 such that the next projectile is accelerated less. In this way, the next projectile passes through the picking path 13 to the catching station at a slower speed. If, on the other hand, a projectile 3 arrives too late, the comparator 5 emits a signal which acts on the servo-motor 9 such that the next projectile is accelerated at a faster speed so as to reach the catching station 2 sooner.

It is to be noted that the error signal received by the servo-motor may indicate a plus or minus deviation of the signal from the pick-off 1 relative to the signal from the pick-off 6. Depending on the sign of the signal the servo-motor 9 adjusts the adjusting screw 11 up or down so as to move the torsion bar 12 to a new zero position. Thus, when the picking mechanism is actuated in known manner, the torsion bar 12 can impose a greater or less accelerating force on a projectile 3.

It is to be noted that the error signal from the comparator may act on a servo-motor of a picking mechanism other than a torsion bar mechanism as shown. Further, the means for adjusting the picking speed may be connected to the main drive rather than to the picking mechanism in order to control the operating speed of the main drive. In this case, a servo-motor can be used which receives the error signal and which functions as a part of an electrical switching system of a drive motor for the drive. The affect of this servo-motor would be to increase the machine speed for a premature arrival of a projectile at the catching station and to decrease the machine speed for a delayed arrival of the projectile.

Referring to FIG. 2, the apparatus for adjusting the picking speed may also be used in a weaving machine in which a fluid, such as air, is used as a picking medium. In this case, for example, a weft yarn 20 can be picked via a main nozzle 21 and one or more auxiliary nozzles 22 until a forward tip or end 23 reaches a catching station at which a catching nozzle 24 is positioned. As above, a pick-off 25 is located at the catching station so as to detect the arrival of the weft yarn 20 and to emit a signal to a comparator 26. Also, as above, a pick-off 27 is located adjacent a main shaft 7 of the weaving machine to generate a signal in response to passage of a tab 8 and to emit the signal to the coparator 26.

The comparator 26 also functions as above to generate an error signal in response to a deviation of the signal from the pick-off 25 from the signal from the pick-off 27.

The weaving machine also includes a supply means for supplying a fluid, such as air, to the main nozzle 21 and the auxiliary nozzles 22. As indicated, the supply means includes a reservoir 29 and a conduit to the main nozzle 21.

A means such as a pressure control valve 28 is connected to the comparator 26 to receive the error signal and to adjust the picking speed of the weft yarn 20 relative to the speed of the weaving machine. The control valve 28 acts as a throttle valve to control the supply of air from the reservoir 29 in response to the error signal. If the error signal indicates the premature arrival of the weft yarn 20 at the catching station, the valve 28 is throttled down to reduce the air pressure at the nozzles 21, 22 so that the next weft is picked more slowly. Conversely, the valve 28 responds to a delayed picking by opening further so that the next pick is accelerated.

As shown in FIG. 2, depending upon the means used to regulate the pick length of the weft yarn 20, use may be made of a weft brake 30 to brake the travel of the weft yarn 20. In this event, the comparator 26 also emits the error signal via a line 31 to a servo-motor 32 for the yarn brake 30. The servo-motor 32 is adapted to respond to the error signal so that the time of braking is adapted to the picking speed.

The invention thus provides an apparatus for adjusting the picking speed of a weft yarn in a weaving machine to the operating speed of the weaving machine in a rapid efficient manner. Further, in the case of the fluid type weaving machine, the control of the picking speed helps to save energy since a premature arrival of a weft yarn in a catching station requires an unnecessary consumption of fluid, e.g. air.

What is claimed is:

1. In a weaving machine, the combination comprising
   a picking mechanism for picking a weft yarn to a weft-catching station at a given speed, said picking mechanism including a torsion bar for effecting a picking of a gripper shuttle and a part for controlling the zero position of said torsion bar to control the acceleration of picking of a weft yarn;
   a first pickoff for generating a first signal in response to the arrival of a weft yarn at said weft-catching station;
   a second pickoff for generating a second signal corresponding to the operating speed of the weaving machine; and
   a comparator connected to each said pickoff to receive and compare said first signal and said second signal and to generate an error signal in response to said first signal deviating from said second signal; said comparator being connected to said part to deliver said error signal for adjusting the picking speed of the weft yarn relative to the speed of the weaving machine in response to said error signal.

2. The combination as set forth in claim 1 which further comprises a drive for driving the weaving machine and wherein said means is a switching device in said drive for controlling the speed of said drive.

3. In a weaving machine, the combination comprising
   a main drive for driving the machine;
   a picking mechanism for picking a weft yarn to a weft-catching station, said picking mechanism including a torsion bar for effecting a picking of a gripper shuttle;

a first pickoff for generating a first signal in response to the arrival of a weft yarn at said weft-catching station;

a second pickoff for generating a second signal corresponding to the operating speed of said drive;

a comparator connected to each said pickoff to receive and compare said first signal and said second signal and to generate an error signal in response to said first signal deviating from said second signal; and means connected between said comparator and one of said picking mechanism and said main drive for receiving said error signal and adjusting the picking speed of said picking mechanism relative to the operating speed of said drive in response to the received error signal, said means including an adjusting screw for determining a zero position for said torsion bar and a servomotor for adjusting the position of said screw, said servomotor being connected to said comparator to receive the error signal therefrom and to adjust said screw in response to said error signal.

4. The combination as set forth in claim 3 wherein said picking mechanism includes a torsion bar for effecting a picking of a gripper shuttle and said means includes an adjusting screw for determining a zero position for said torsion bar and a servomotor for adjusting the position of said screw, said servomotor being connected to said comparator to receive the error signal therefrom and to adjust said screw in response to said error signal.

5. The combination as set forth in claim 3 wherein said means is connected to said main drive for controlling the operating speed of said main drive.

6. In a weaving machine, the combination comprising a picking mechanism for picking a weft yarn to a weft-catching station at a given speed, said picking mechanism including a part for controlling the acceleration of picking of a weft yarn and a means for supplying a fluid for picking a weft yarn;

a first pickoff for generating a first signal in response to the arrival of a weft yarn at said weft-catching station;

a second pickoff for generating a second signal corresponding to the operating speed of the weaving machine;

a comparator connected to each said pickoff to receive and compare said first signal and said second signal and to generate an error signal in response to said first signal deviating from said second signal;

means connected to said comparator to receive said error signal and to control the propelling pressure of the supplied fluid in response to said signal to adjust the picking speed of the weft yarn relative to the speed of the weaving machine;

a weft yarn brake for braking the picking of a weft yarn; and means connected between said comparator and said brake for adjusting said brake in response to said error signal.

7. In a weaving machine, the combination comprising a main drive for driving the machine;

a picking mechanism for picking a weft yarn to a weft-catching station, said picking mechanism including a servo-motor for controlling the picking speed of said mechanism;

a first pickoff for generating a first signal in response to the arrival of a weft yarn at said weft-catching station;

a second pickoff for generating a second signal corresponding to the operating speed of said drive;

a comparator connected to each said pickoff to receive and compare said first signal and said second signal and to generate an error signal in response to said first signal deviating from said second signal; said comparator being connected to said servomotor to deliver said error signal to said servomotor for adjusting the picking speed of said picking mechanism relative to the operating speed of said drive.

8. In a weaving machine, the combination comprising a main drive for driving the machine;

a picking mechanism for picking a weft yarn to a weft-catching station, said picking mechanism including at least one nozzle for passage of a weft yarn therethrough and supply means for supplying a fluid to said nozzle to propel a weft yarn therethrough;

a first pickoff for generating a first signal in resonse to the arrival of a weft yarn at said weft-catching station;

a second pickoff for generating a second signal corresponding to the operating speed of said drive;

a comparator connected to each said pickoff to receive and compare said first signal and said second signal and to generate an error signal in response to said first signal deviating from said second signal;

a control valve connected between said comparator and said picking mechanism for receiving said error signal to control the propelling pressure of the fluid supplied to said nozzle from said supply means for adjusting the picking speed of said picking mechanism relative to the operating speed of said drive;

a weft yarn brake for braking the picking of a weft yarn; and means connected between said comparator and said brake for adjusting said brake in response to said error signal.

* * * * *

UNITED STATES PATENT AND TRADEMARK OFFICE

CERTIFICATE OF CORRECTION

PATENT NO. : 4,458,726

DATED : July 10, 1984

INVENTOR(S) : Ernst Wenig

It is certified that error appears in the above-identified patent and that said Letters Patent is hereby corrected as shown below:

| Column | Line | Correction/Change From | To |
|---|---|---|---|
| 1 | 28 | "discrepencies" | -- discrepancies -- |
| 3 | 52 | "affect" | -- effect -- |
| 3 | 68 | "coparator" | -- comparator -- |
| 6 | 36 | "resonse" | -- response -- |

Signed and Sealed this

*Eighteenth* Day of *December 1984*

[SEAL]

*Attest:*

*Attesting Officer*

GERALD J. MOSSINGHOFF

*Commissioner of Patents and Trademarks*